US005621170A

United States Patent [19]

Saulsberry

[11] Patent Number: 5,621,170

[45] Date of Patent: Apr. 15, 1997

[54] METHOD FOR TESTING GAS WELLS IN LOW PRESSURED GAS FORMATIONS

[75] Inventor: Jerrald L. Saulsberry, McCalla, Ala.

[73] Assignee: Gas Research Institute, Chicago, Ill.

[21] Appl. No.: 431,543

[22] Filed: May 1, 1995

Related U.S. Application Data

[63] Continuation of Ser. No. 140,636, Oct. 20, 1993, abandoned.

[51] Int. Cl.[6] ..... E21B 47/00

[52] U.S. Cl. ..... 73/152.37; 73/152.39

[58] Field of Search ..... 73/155, 152.37, 73/152.39; 166/250, 268

[56] References Cited

U.S. PATENT DOCUMENTS

| | | | |
|---|---|---|---|
| 3,771,360 | 11/1973 | Prats | 73/155 |
| 4,120,354 | 10/1978 | Ridley et al. . | |
| 4,143,714 | 3/1979 | Agnew . | |
| 4,223,727 | 9/1980 | Sustek, Jr. et al. . | |
| 4,688,637 | 8/1987 | Theis . | |
| 4,694,692 | 9/1987 | Brown et al. . | |
| 4,733,233 | 3/1988 | Grosso et al. . | |
| 4,817,713 | 4/1989 | Nguyen et al. . | |
| 4,821,564 | 4/1989 | Pearson et al. . | |
| 4,838,079 | 6/1989 | Harris . | |
| 4,867,254 | 9/1989 | Gavignet . | |
| 4,928,522 | 5/1990 | Tonnelli . | |
| 4,972,705 | 11/1990 | Fryer et al. . | |
| 5,131,471 | 7/1992 | Duerksen et al. . | |
| 5,151,658 | 9/1992 | Muramatsu et al. . | |
| 5,156,205 | 10/1992 | Prasad . | |
| 5,209,300 | 5/1993 | Ayres . | |
| 5,209,301 | 5/1993 | Ayres . | |
| 5,287,741 | 2/1994 | Schultz et al. . | |

OTHER PUBLICATIONS

J.L. Saulsberry, "A New Low Cost Method of Performing Well Tests in Under Pressured Coal Seams," Proceedings of the 1993 International Coalbed Methane Symposium, The University of Alabama/Tuscaloosa, May 17–21, 1993.

J.L. Saulsberry, "Cost Reduction of Injection Tests for Under–Pressured Reservoirs," Society of Petroleum Engineers Gas Technology Symposium, Calgary, Alberta, Canada, Jun. 28–30, 1993.

Robert C. Earlougher, Jr., Advances in Well Test Analysis, SPE of AIME, Second Printing, 1977.

H.K. Chen, W.E. Brigham, "Pressure Buildup for a Well With Storage and Skin in a Closed Square," SPE–AIME 44th Annual California Regional Meeting, San Francisco, Apr. 4–5, 1974.

H.C. Slider, *Worldwide Practical Petroleum Reservoir Engineering Methods*, PennWell Publishing Co., Tulsa, OK.

J.P. Seidle, G.M. Kutas, L.D. Krase, "Pressure Falloff Tests of New Coal Wells," SPE Rocky Mountain Regional Meeting and Low–Permeability Reservoirs Symposium, Denver, CO, Apr. 15–17, 1991.

M.D. Zuber, D.P. Sparks, W.J. Lee, "Design and Interpretation of Injection/Falloff Tests for Coalbed Methane Wells", SPE 65th Annual Technical Conference and Exhibition of the Society of Petroleum Engineers, New Orleans, LA, Sep. 23–26, 1990.

*Primary Examiner*—Richard Chilcot
*Assistant Examiner*—Harshad Patel
*Attorney, Agent, or Firm*—Speckman, Pauley & Fejer

[57] ABSTRACT

The "Tank Test" method for determining well tests in low pressured reservoirs utilizes gravity drainage from a water storage tank to inject water into the reservoir. The Tank Test eliminates the need for expensive pumping equipment and the required manual pump rate adjustments. The low costs associated with the Tank Test allows the test to be run for a longer duration so that a greater portion of the reservoir can be investigated. The duration of the test and thus the radius investigation can be extended by repeatedly refilling the tank as necessary. The Tank Test also reduces the possibility of fracturing the reservoir during injection tests in low permeability reservoirs. The primary criteria for performing a tank test is that the hydrostatic head from the tank to the formation be greater than the reservoir pressure. In addition, the Tank Test minimize stress effects on stress sensitive formations.

16 Claims, 11 Drawing Sheets

METHOD FOR TESTING GAS WELLS IN LOW PRESSURED GAS FORMATIONS

This is a continuation of copending application(s) Ser. No. 08/140,636 filed on 20 Oct. 1993, now abandoned.

FIELD OF THE INVENTION

This invention relates to the testing of gas wells in low pressured formations where injection fluids can fracture the formation or the costs associated with traditional well testing methods are uneconomical. In this invention, water is injected into the formation by gravity feed.

BACKGROUND OF THE PRIOR ART

In many cases, low reservoir permeability is the critical factor limiting production rates. This places a great deal of importance on well testing because the decision of whether to develop an area often hinges on the reservoir permeability. Accurate permeability determination is also important for making intelligent decision about stimulation designs and well spacing.

Slug tests and injection/falloff tests are the two most common methods of testing water saturated coal seams in the Warrior Basin. Slug tests are simpler and more economical to perform than injection/falloff tests, but the practical radius of investigation of a slug test is relatively short. Reservoir heterogeneities are also much more difficult to interpret with a slug test than with a properly performed injection/falloff test. The major disadvantages of injection/falloff tests are the high cost of the tests and if not performed correctly, may provide un-analyzable or misleading data. Injecting at too high of a rate and fracturing the coal has invalidated many injection/falloff tests performed in the Warrior Basin. Even after Zuber, et al. published a paper that indicated the need for low injection rates, fracturing during injection is still common. Problems most often arise when testing thin seams with low permeability. The low permeability seams often require pumping rates well below the commonly used rate of 0.5 gal./min. and the test duration needs to be longer to achieve the same radius of investigation as a test performed in a more permeable reservoir.

SUMMARY OF THE INVENTION

The "Tank Test" method for determining well tests in low pressured reservoirs utilizes gravity drainage from a water storage tank to inject water into the reservoir. The Tank Test eliminates the need for expensive pumping equipment and the required manual pump rate adjustments. The low costs associated with the Tank Test allows the test to be run for a longer duration so that a greater portion of the reservoir can be investigated. The duration of the test and thus the radius investigation can be extended by repeatedly refilling the tank as necessary. The Tank Test also reduces the possibility of fracturing the reservoir during injection tests in low permeability reservoirs. The primary criteria for performing a tank test is that the hydrostatic head from the tank to the formation be significantly lower than the reservoir pressure. Typically, this pressure differential is at least 50 psi.

DESCRIPTIONS OF THE DRAWINGS

The nature and characteristic features of the invention will be more readily understood from the following description taken in connection with the accompanying drawings, in which.

Understand that the description and the figures are merely illustrative and that various modifications and changes can be made in the structure disclosed without departing from the spirit of the invention.

PREFERRED EMBODIMENT

Figure 1:
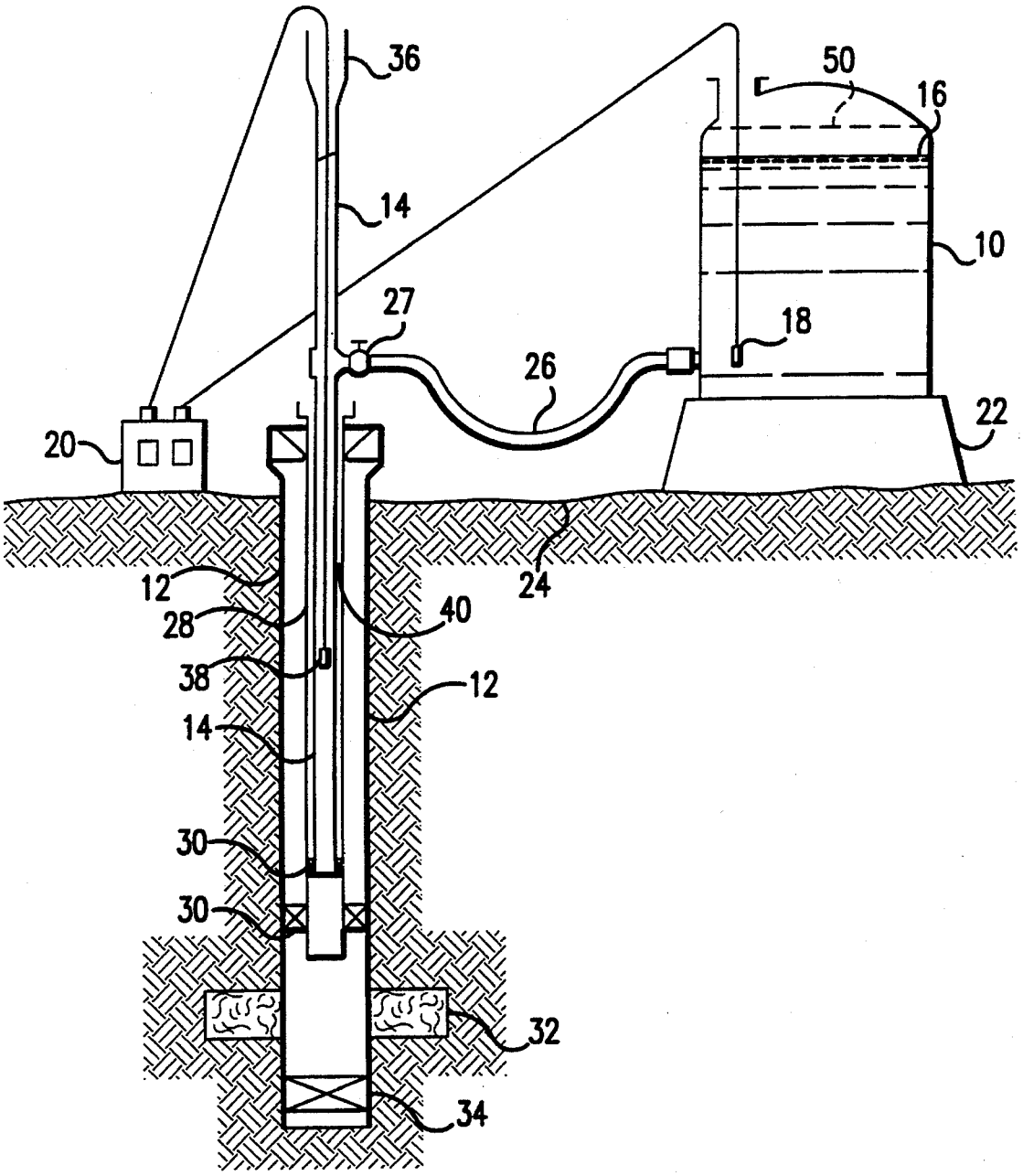
FIG. 1 is a schematic illustrating equipment used in the tank test and utilizing small diameter tubing to reduce wellbore storage.

This invention is a well testing procedure that provides a low cost alternative to the normal constant rate injection/falloff tests, for testing under or low pressured gas reservoirs. Typically, these low pressure reservoir environments occur in coal seams. The new method, referred to as the "Tank Test"uses gravity drainage from a water storage tank to inject water into the reservoir formation in place of the pumping equipment normally used. FIG. 1 illustrates how a tank can be connected to a well so that hydrostatic pressure can be used to inject water into a well.

FIG. 1 illustrates a schematic illustrating equipment used in the tank test and utilizing small diameter tubing to reduce wellbore storage. A tank 10, with preferably a constant cross-sectional area to simplify injection rate determination, is located near a gas well having casing 12. The tank 10 should be preferably located at a reference point above the horizontal plane that intersect the point of injection of the water into the tubing 14. The injection rate during a Tank Test can be determined by measuring how the water level line 16 in the tank 10 changes over a period of time. Calculating the flow rate based on the changing water level line 16 is often simpler and more accurate than using a flow meter when dealing with the very low flow rates often encountered.

One method of acquiring this data is utilizing an accurate low pressure gauge 18 along with a means for recording the data or a data acquisition unit 20. The data acquisition unit 20 can continuously monitor the changing water level 16. Operators should also manually measure the level in the tank 10 to provide backup data. The tank size should be large enough to avoid a large number of refilling, but small enough that the water level changes sufficiently for accurate rate determination. The method of estimating the tank size is discussed later in test design.

A hose or pipe 26 can be used to connect the tank 10 to the tubing 14. The diameter of the connection line should be sufficiently large to prevent restriction of the injection flow rate. A water shut off valve 27 should be preferably located along the pipe 26, but in very close proximity to the tubing 14 to initiate or terminate the injection of water into the tubing 14. Location of the water shut off valve 27 close to tubing 14 minimizes the amount of water remaining in the tubing after shut-in.

To maximize the amount of water that can be drained from a tank, the tank should be uphill from the well if the ground is not level. Small tanks may be elevated in relation to the wellhead by placing them on a stand 22 or flatbed trailer. In any event, the water level line 16 should never fall below the point where the pipe 26 connects to the tubing 14.

A tubing and packer arrangement should be installed in the well as illustrated in FIG. 1. FIG. 1 illustrates tubing 14 located within the production tubing 28. Both the tubing 14 and the production tubing 28 are stabilized by packers 30. The packers and lower ends of the tubing 14 and production tubing 28 should be located above the formation 32. However, it is possible to equip the well with only one set of tubing. FIG. 1 illustrates an equipment arrangement when the formation has low permeability and well bore storage is minimized. Conversely, if the formation has high permeability, well bore storage is less critical, therefore a larger tubing could be used. The production tubing 28 usually has an outside diameter of 2⅜ to 2¾ inches. The inner tubing is typically 1 inch in diameter.

If the formation of inquiry communicates with other formations, a bridge plug 34 should be located below the formation of formation 32 to isolate this formation 32 from other formations.

The tubing 14 should extend above the top of the tank 10 or at least above the maximum water level 50 in the tank 10. This will allow the well to vent during injection without having water overflowing the top of the tubing 14. An expansion chamber 36 may be added to the top of the tubing 14 to minimize water loss from slugging during the initial filling of the well. If the injection starts very rapidly, air in the tubing will be compressed during fill-up and water will be expelled out of the top of the tubing 14 as gas bubbles rise.

To minimize wellbore storage effects, small diameter tubing (1 to 1½ inch) or downhole shut-in equipment may be used. Downhole shut-in equipment will dramatically reduce wellbore storage effects compared to small diameter tubing, but will require memory gauges and will increase the cost of a test considerably. When using small diameter tubing it is important that the tubing be clean and free of scale. Excessive pipe dope should also be avoided. Depending on the packer used, the mandrel inside diameter may be as small as ⅜ inch and can easily plug.

Experience has shown that gauges and recorder instruments intended for ground water monitoring provide an excellent, low cost alterative to the usual oil field gauges. Typically, a ground water monitoring gauge and data acquisition unit could be purchased for about the cost of renting high quality oil field gauges for a week. The ground water monitoring gauges cannot be used with downhole shut-in equipment. Two of these gauges are used for a Tank Test performed without downhole shut-in equipment. An accurate 5 psi gauge 18 is placed in the tank for recording how the water level 16 changes with time, and a higher pressure gauge 38 is hung in the well for monitoring the falloff data. The gauge 38 placed in the well should be at a level below the reservoir's equilibrium water level 40 but not deep enough to exceed the rating of the gauge.

Figure 2:
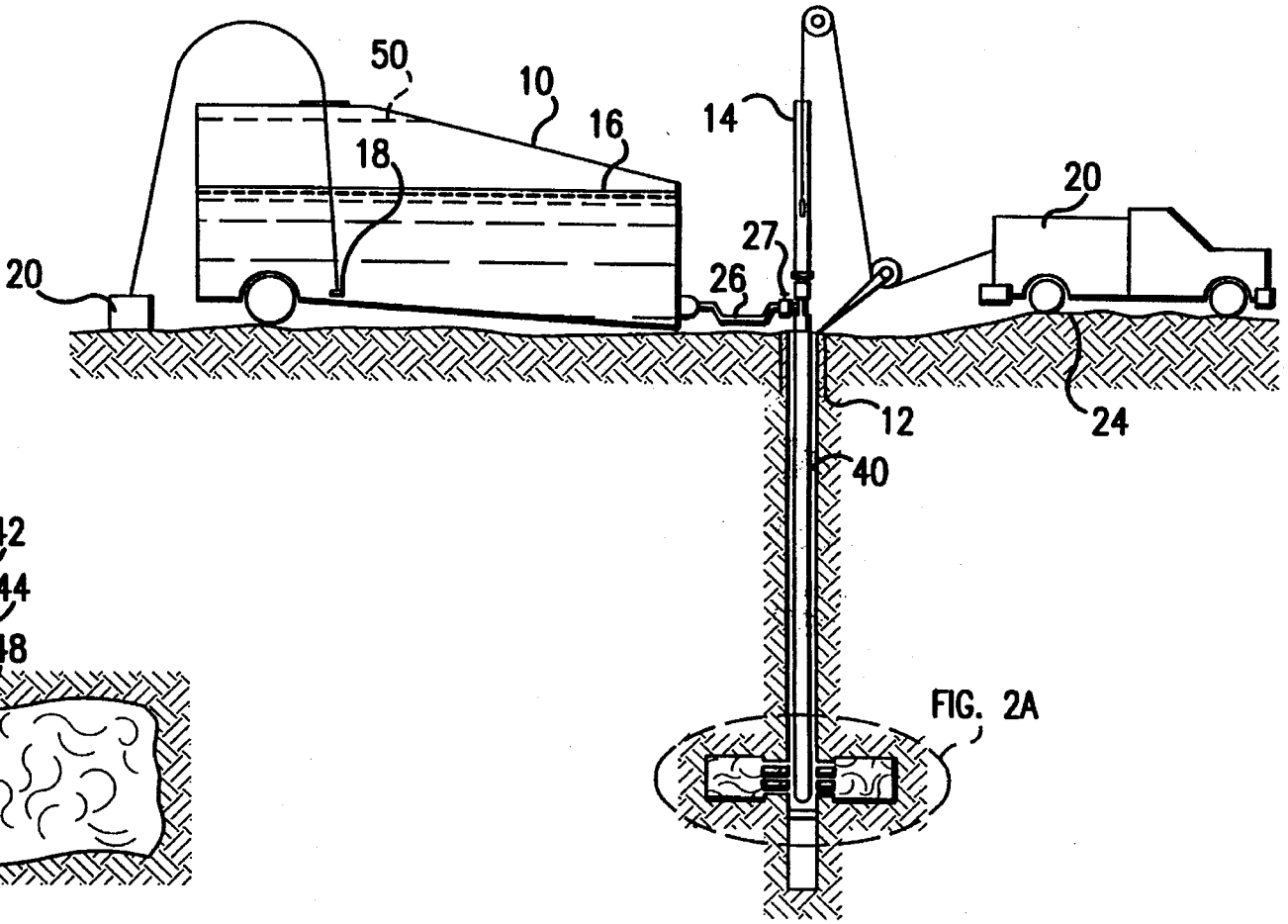
FIG. 2 is a schematic of the downhole shut-in equipment used in the tank test.
Figure 2A:
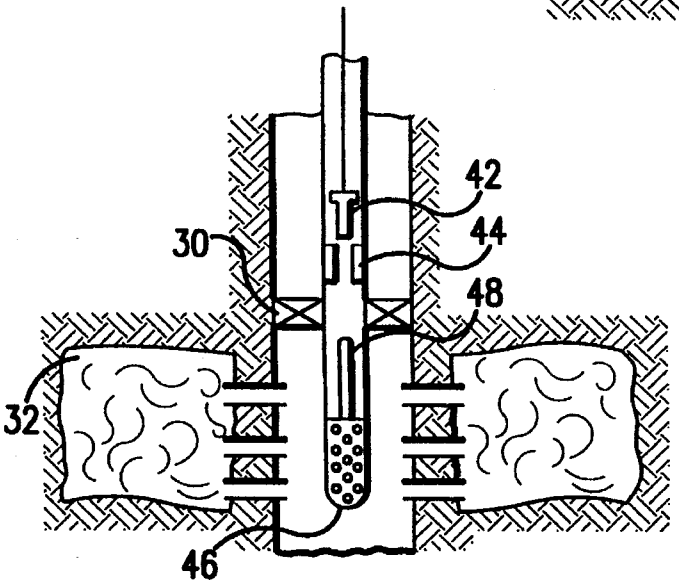

FIG. 2 illustrates a schematic of the equipment layout if shut-in equipment is used in the tank test. This schematic, a frac tank is used as the water storage tank 10. The shut-in equipment consists of a plug 42 and a seating nipple 44. Suspending adjacent to the formation 32 is a perforated pup joint 46 to allow the flow of fluids into and out of the tubing 14. Inside the perforated pup joint 46 is located memory gauges 48 for recording the pressure. Unlike the equipment set up in FIG. 1, the pressure readout in the wellbore is not automatically fed to the means for recording data 20. When downhole shut-in equipment is used, the memory gauges 48 must be retrieved from the well before downloading the pressure data.

Before performing a Tank Test on a new well it is important to establish good communication between the wellbore 12 and the reservoir or formation 32. A small breakdown treatment may be sufficient to accomplish this task. After the tubing 14 is installed in the well, the equilibrium water level 40 is measured. If location of the equilibrium water level 40 is below the ground surface 24, the formation is under pressured. Reservoir pressure can be calculated based on the hydrostatic gradient.

The tank 10 should be setup and connected to the well and filled with clean filtered water. To start the test, the tank gauge 18 should be started and the valve 27 at the wellhead opened. The injection duration can be continued as long as desired by refilling the tank 10 as needed. Refills should be made as rapidly as possible, and the tank should be strapped before and after each refill. The time and duration of each refill should also be recorded. To avoid a flow interruption, it is important to maintain the water level 16 in the tank 12 above the level of the valve 27 at the wellhead during injection.

After the desired injection duration is reached, the falloff portion of the test can be initiated by starting the gauge 38 in the well and closing the valve 27 at the wellhead. If downhole shut-in equipment is used, the downhole shut-in time-will need to be coordinated with the programming of the downhole memory gauges 48.

After a sufficient injection period, the valve 27 at the wellhead is closed and the falloff data is collected. By eliminating the pumping equipment and associated manpower, the cost of performing a falloff test is dramatically reduced. Tremendous savings on gauges can also be made by using gauges intended for ground water monitoring in place of oil field gauges. The low cost of performing a Tank Test makes it economical to perform longer duration tests than would be feasible with customary injection/falloff tests. The longer test duration provides a greater radius of investigation, which should result in a permeability estimates that is more representative of the reservoir. The Tank Test also virtually eliminates the problem of fracturing the formation or coal seam during injection.

The Tank Test procedure may be used as pre or post-frac test, but it is primarily intended to be a method of testing new wells before any production. The idea is to test the formation while it is still water saturated. Once gas desorption is initiated, testing becomes more complex due to relative permeability effects and gas adsorption or desorption. If the reservoir is not water saturated it may still be possible to use the Tank Test procedure by injecting enough water to create a water saturated zone near the wellbore. The early time falloff response, before the pressure transient has reached the edge of the water bank, can be analyzed by conventional single phase methods.

The primary criteria for performing a tank test is that the hydrostatic head from the tank to the formation be significantly lower than the reservoir pressure.

EXAMPLE 1

Test Well

Figure 3:
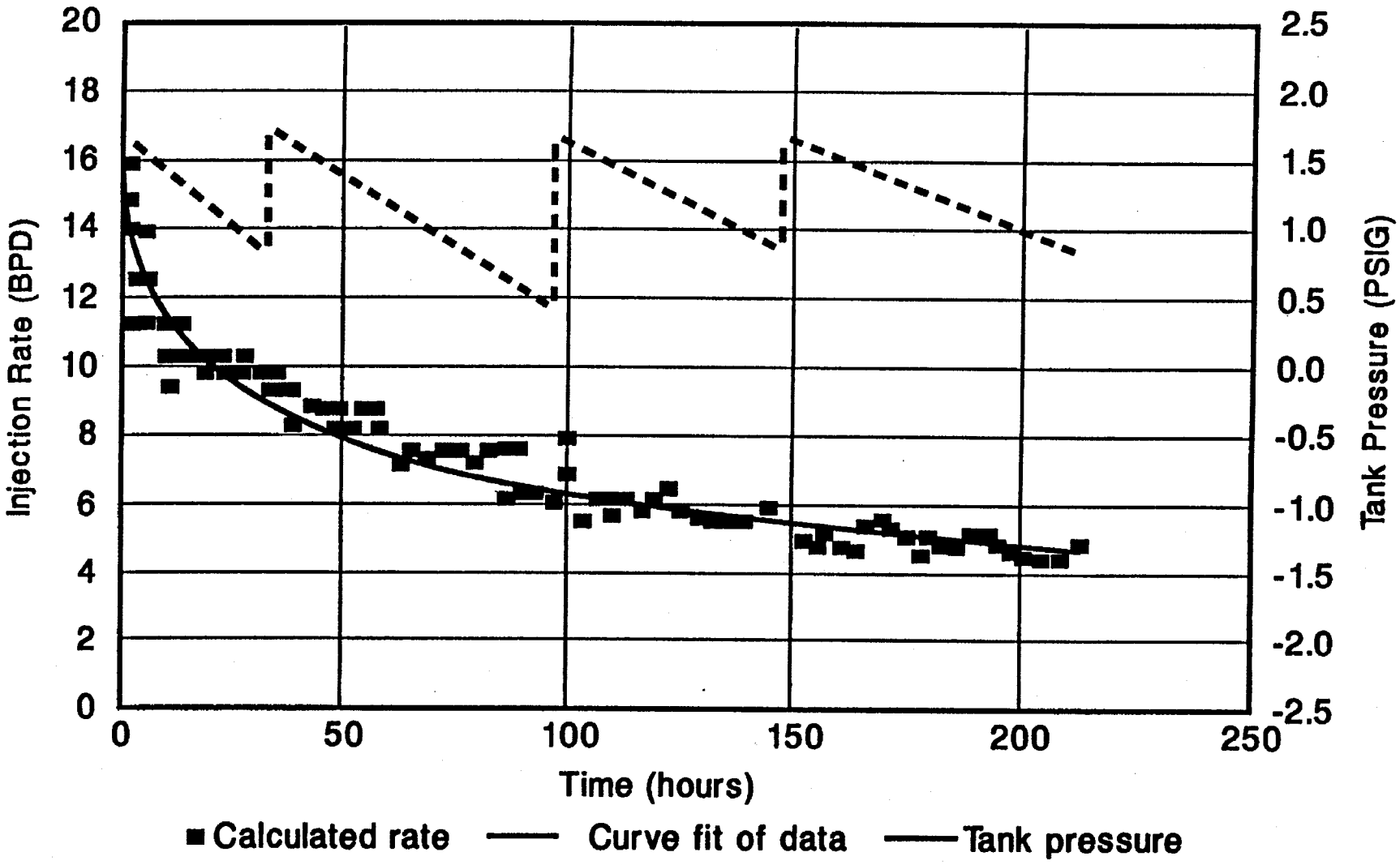
FIG. 3 is a graph illustrating the pre-fracture injection rate of the first example test well where the sudden increases in tank pressure is due to the tank being refilled.

The first field test of the Tank Test was performed on the Blue Creek coal seam of Well P8 at the Rock Creek research site. The Blue Creek coal seam is 4.7 ft thick, at a depth of 974 ft, and was water saturated and under-pressured by 84 psi. Well P8 was equipped with 1.315 inch tubing and connected to a 1300 gal tank as illustrated in FIG. 1. An accurate 5 psi pressure gauge was used to record the pressure in the tank during injection. The gauge pressure was convened into water level, and the injection rate was calculated based on the cross sectional area of the tank and the rate of water level change. FIG. 3 illustrates the tank pressure and the calculated injection rate. During the 215 hour injection, the tank was refiled three times. The tank refills had very little effect on the injection rate. The injection rate data was smoothed by performing a least squares curve fit of the injection rate. The curve fit of the injection rate was used with superposition to account for the effect of the changing injection rate on the falloff data. The same results were obtained by using the last injection rate along with an equivalent injection time, The equivalent injection time is obtained by dividing the cumulative injection volume by the injection rate just before shut-in.

Figure 4:
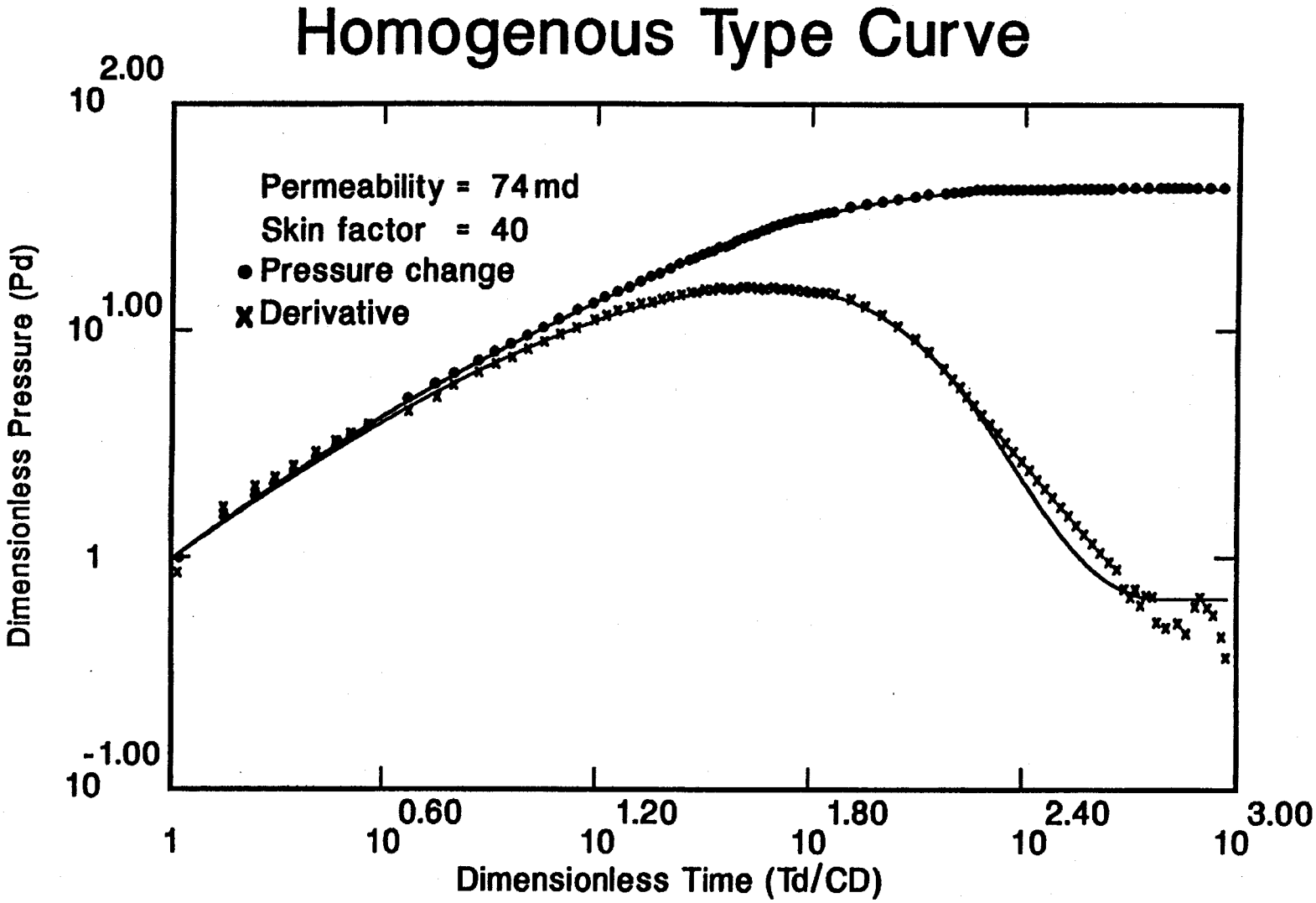
FIG. 4 is a graph illustrating the type curve match of a pre-stimulation tank test falloff data of the first example test well.

FIG. 4 illustrates the type curve matching of the falloff data indicated a permeability of 74 md and skin factor of 40. The 74 md permeability is unusually high for the Blue Creek coal seam in Oak Grove, and the skin factor is also very high considering the well was treated with a breakdown treatment prior to the testing. It was hypothesized that the high skin was not due to formation damage but was an indication of a heterogeneous reservoir. It is believed that there may be a highly permeable fracture system surrounding the well, but the wellbore had not intersected any of the natural fractures.

In an attempt to access the fracture system and get through the skin zone, a small simulation was implemented on well P8. The stimulation was kept small to minimize the duration of linear flow during the planned post-frac test. A linear 30-lb/1,000 gal hydroxyethycellulose (HEC) gel in a 2% KCI solution was used as the frac fluid. Total pump time of the stimulation was only 4 minutes and less than 700 gal of fluid and 600 lbs of proppant were used.

Figure 5:
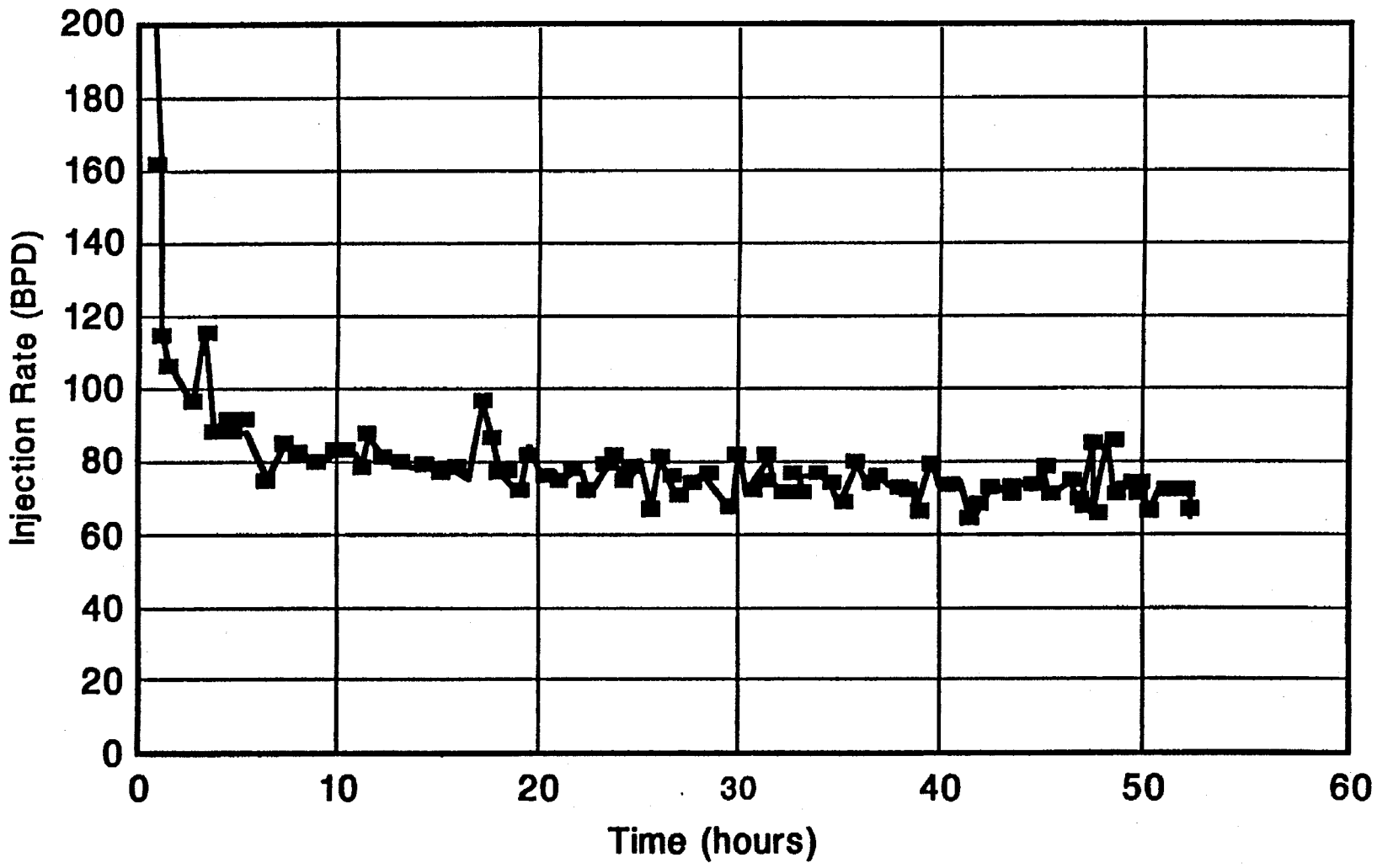
FIG. 5 is a graph illustrating the post-fracture injection rate of a tank test performed at the first example test well.
Figure 6:
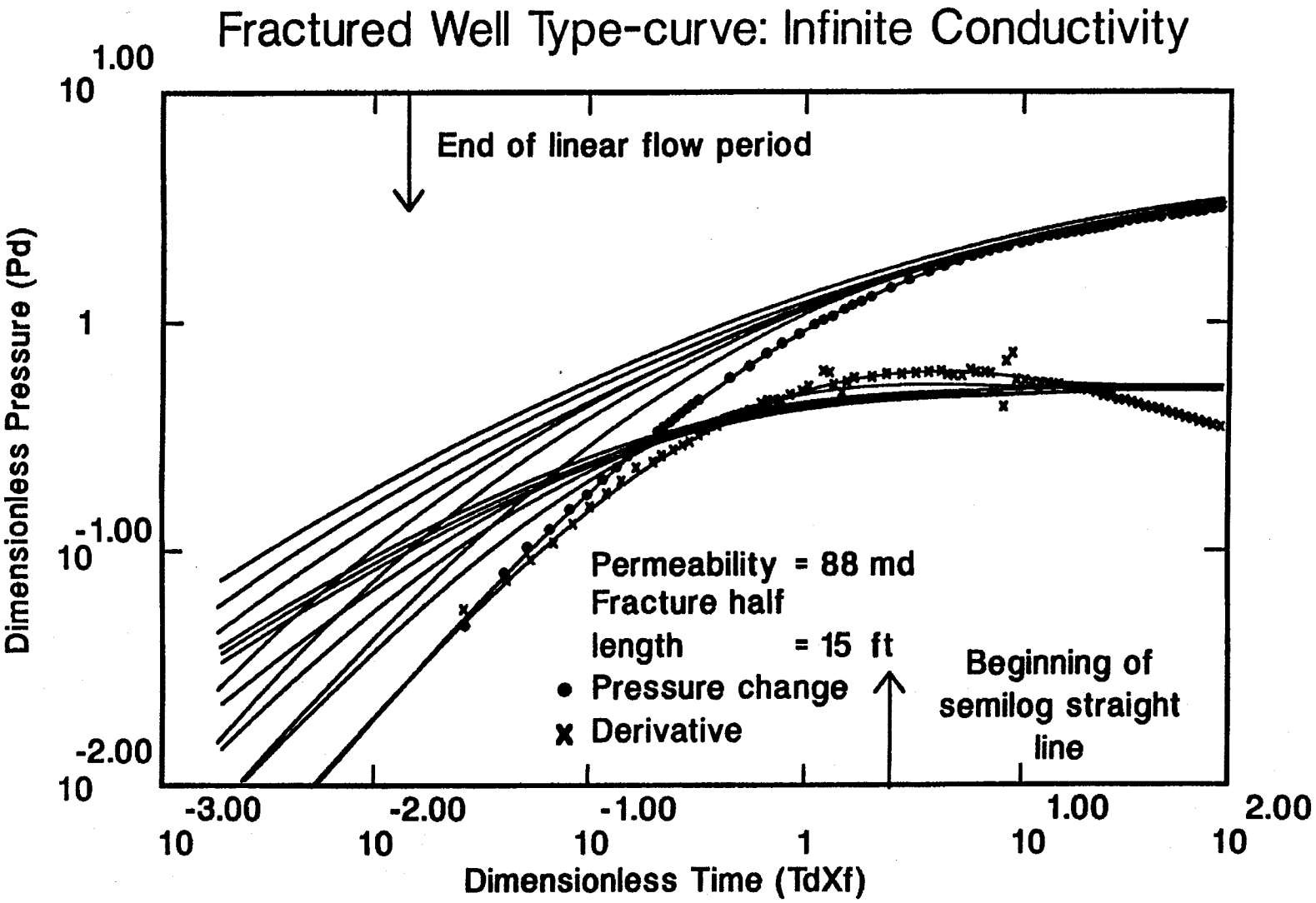
FIG. 6 is a graph illustrating the type curve match of a post-fracture tank test falloff of the first example test well.

After the stimulation, a second Tank Test was performed on well P8 using the same setup as the first test. The injection rate into the well was about 15 times as high as the pre-stimulation test, and the tank was refilled 8 times during the 52 hours of injection (FIG. 5). Analysis of the falloff data indicated that the small fracture penetrated beyond the skin zone as planned, and the type curve match indicated a fracture half length of 15 ft with infinite conductivity or an equivalent skin factor of −3.13 (FIG. 6). The pseudo-radial flow portion of the test indicated a permeability of 88 md which is reasonably close to the 74 md of the pre-frac test.

EXAMPLE 2

Test Well

A Tank Test was performed on the Pratt Coal Group in the Deerlick Creek Field. The coal group is about 1200 ft deep with 3.5 ft of coal open to perforations. A small acid injection breakdown treatment was performed on the well to improve communication between the wellbore and the coal. The well was then equipped with 1.315"tubing and a 1300 gallon tank was hooked up to perform the Tank Test. The injection period took ten days and then the well was shut-in for seven days of falloff. The tank, gauges, and recorders used in this test were the same as those used in the tests performed at Rock Creek (Example 1 Test Well).

Figure 7:
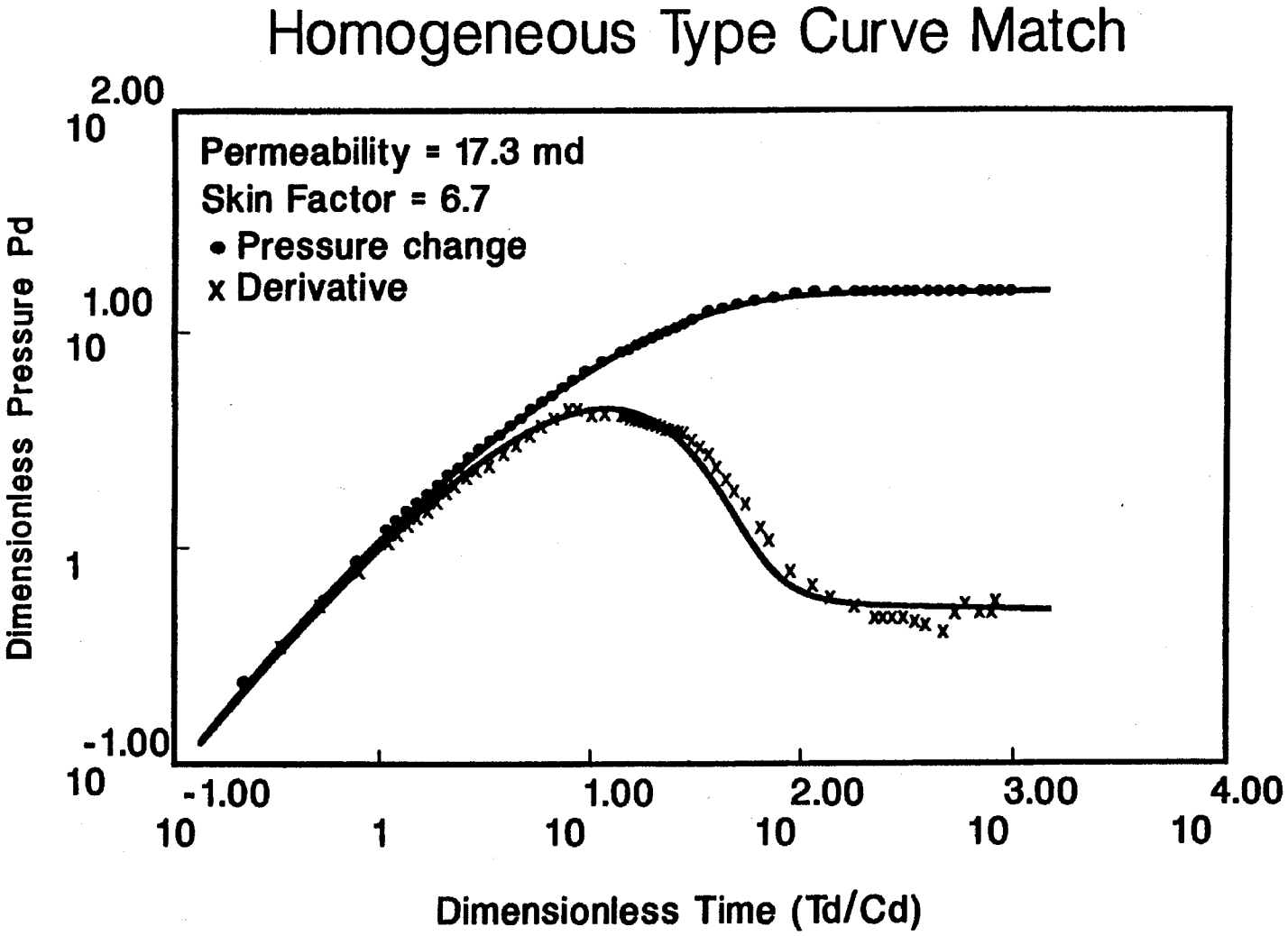
FIG. 7 is a graph illustrating the type curve match of a pre-fracture tank test falloff data for the second example test well.

The injection rate stabilized at 4.9 gal/hr, and the tank was refilled only once during the ten day injection. The extended injection period would have been very expensive if normal pumping equipment had been used instead of the tank. Analysis of the falloff data indicated a permeability of 17 md with a skin factor of 7, despite the acid breakdown treatment (FIG. 7). The radius of investigation of the test is estimated to have been about 700 ft.

Figure 8:
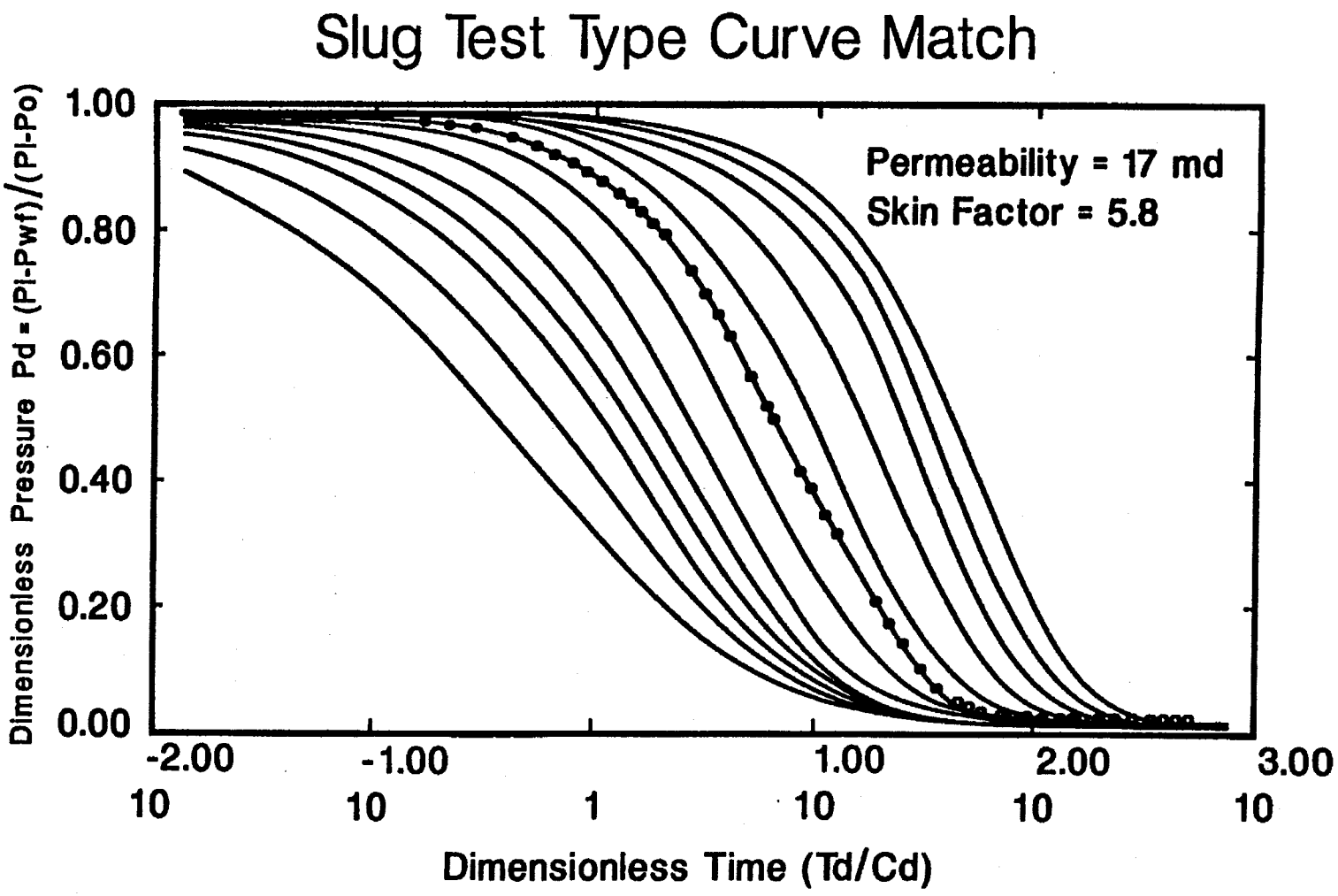
FIG. 8 is a graph illustrating the type curve match of a pre-fracture slug test for the second example test well.
Figure 9:
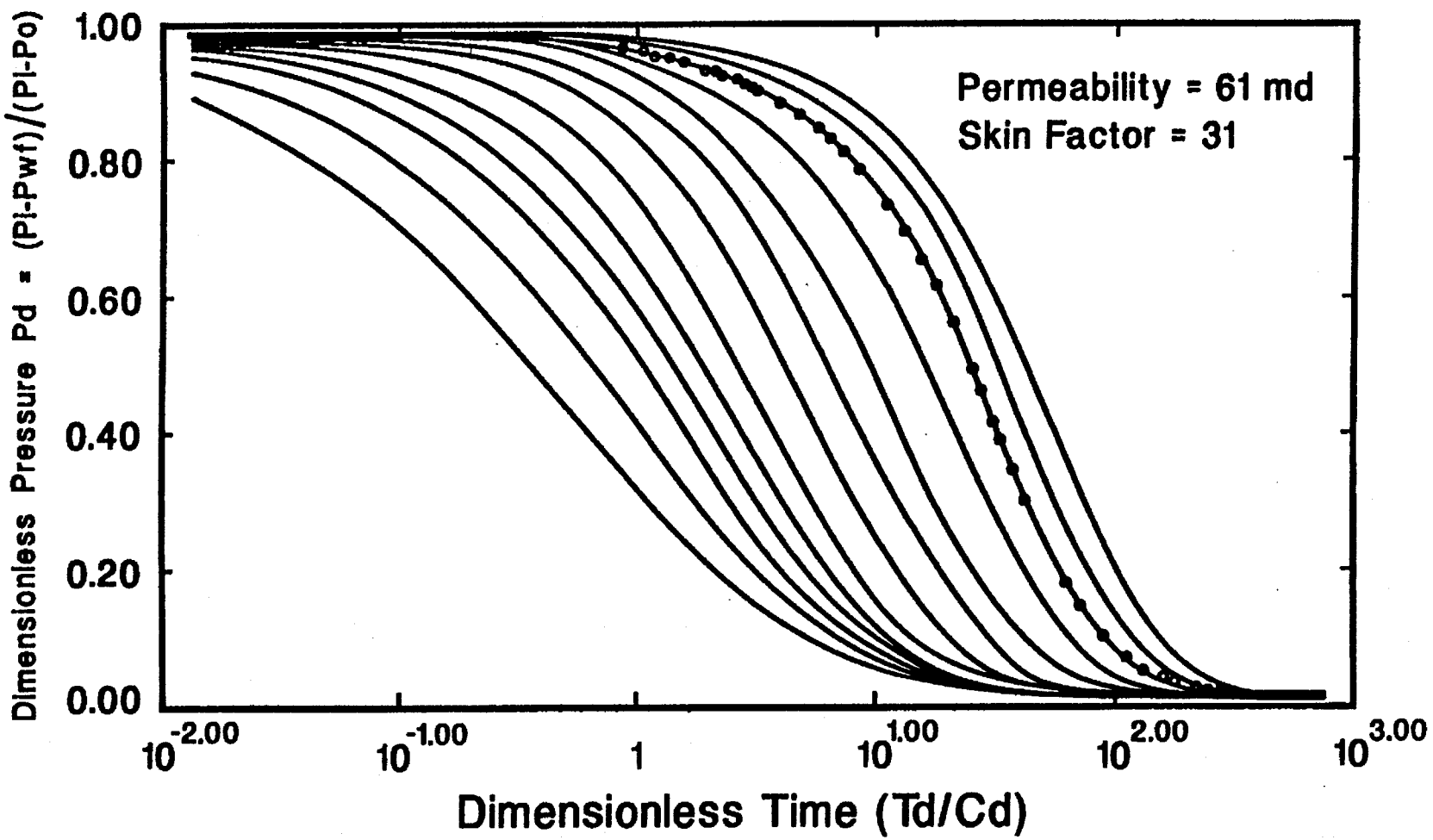
FIG. 9 is a second graph illustrating the type curve match of a pre-fracture slug test for the second example test well.

A slug test was performed as a follow up test on the same well. A type curve match of the slug test data indicated good agreement with the Tank Test. FIG. 8 illustrates the type curve match indicating a permeability of 17 md and a skin factor of 5.8. While the slug test results also agree with the Tank Test results, the uniqueness of the slug test results is much more questionable than the Tank Test. This is illustrated in FIG. 9 which shows a match of the same slug test data with a different curve. This match appears to be good but gives a permeability of 60 md. The confidence of the falloff data from the Tank Test is much greater. A non-linear regression type curve match of the Tank Test data indicated that within a 95% confidence interval the permeability would not vary by more than plus or minus 3.3 md.

EXAMPLE 3

Test Well

Tank Tests were performed on three wells completed in the Antrim Shale in Michigan. The tested zones of these wells were between depths of 1014 and 1152 feet and having net formation thicknesses of 92 and 95 feet respectively. Reservoir pressure gradients were between 0.2 and 0.24 psi/ft. One of the wells was previously hydraulically fractured. The wells were expected to have a relatively high transmissibility, so 500 bbl. frac tanks were used for the tests. Each well was equipped with 2⅜ inch tubing, a packer, and a bottomhole assembly consisting of a perforated sub, seating nipple, and a bull plug on the bottom. This arrangement is illustrated in FIG. 2. The frac tanks were set up at each well and filled with formation brine. Two inch pipe was used to connect the tanks to the wellhead.

During the injection period, the water level in each tank was measured by a 5 psi ground water monitoring gauge and by strapping the tanks. The water levels determined by the two methods were usually within a half an inch of each other. Since the cross sectional area of the tanks varied with the height of the tanks, it was necessary to use a tank volume table to convert water level measurements to volumes. The injection rates were then calculated by dividing the changes in volume by the changes in time. The calculated rate versus time profiles for the tests were not as smooth as the rates for the previous example test wells. When using tanks with variable cross sectional areas and injection rates are relatively large, use of a flow meter may yield better results.

Injection durations for the three wells varied from 6 to 17 hours. The highest rate and the shortest injection was for the well which was previously hydraulically fractured. During the first hour, the injection rate of the hydraulically fractured well exceeded 65 bbl/hr. Due to the high permeability-thickness (7,560 md-ft) and negative skin factor, the injection rate was never high enough for the water level in the well to reach the surface. The injection flow rate was limited by friction in the 2 inch line connecting the tank to the wellhead. The water injection rate declined to 38 bbl/hr as the water head in the tank decreased. The restricted injection rate did not appear to compromise the test results.

Figure 10:
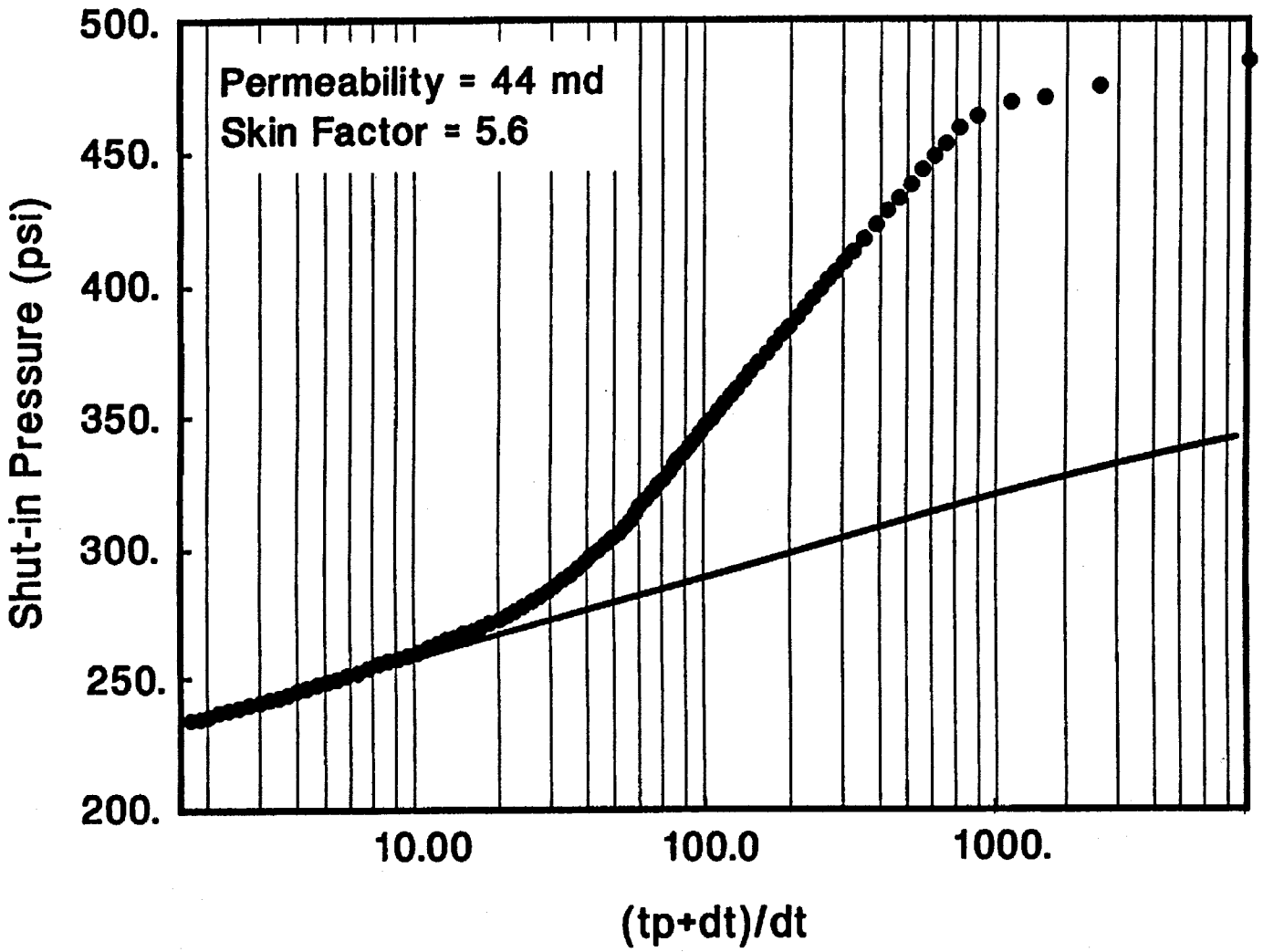
FIG. 10 is a graph illustrating the Homer plot results of the falloff of a tank test performed on the third example test well.

Friction loss through the surface connection pipe did not restrict the injection rates of the other two test wells. At the end of the injection periods for the other two test wells, the injection rates were 1 and 21 bbl/hr respectively. Both of these two tests were also successful in providing useful falloff results. FIG. 10 illustrates the Horner plot results for the 21 bbl/hr injection rate well.

Test Design

The three major considerations for designing a pre-frac Tank Test are test duration, wellborn configuration, and tank size. The following guidelines can be used to design a Tank Test that should provide usable results.

Relatively long test durations are preferred because this increases the radius of investigation of the test and provides time for wellbore storage effects to diminish. The low cost of performing Tank Tests make long duration tests feasible. The end of wellbore storage effects can be estimated by the following equation:

$$t_{wbs}=\frac{170{,}000Ce^{0.14s}}{kh/u}$$

If the water level is changing in the well during the test, the wellbore storage coefficient is determined from:

$$C=\frac{144A}{5.615\rho}$$

If the water level remains constant, the wellbore storage coefficient is determined from:

$$C=\frac{V_w c_w}{5.615}$$

The falloff duration should be at least several times longer than $t_{wbs}$ and some commentators have recommend using a duration nine times as long as that predicted by the $t_{wbs}$ equation. If $t_{wbs}$ is an impractical long period of time, the wellbore storage coefficient can be reduced by installing smaller diameter tubing in the well or using downhole shut-in. The wellbore storage coefficient of 1.315 inch tubing is only 28% of that of 2⅜ inch tubing. Downhole shut-in equipment will also reduce the wellbore storage much more dramatically, but will require memory gauges and will increase the cost of the test considerably.

The radius of investigation of the test can be calculated by:

$$r_i=0.029\sqrt{\frac{kt}{\phi\mu c_t}}$$

Due to the large compressibility factor of coal the radius of investigation is usually significantly smaller than the well spacing. It is recommended that the injection duration be just as long as the falloff duration of the test.

Figure 11:
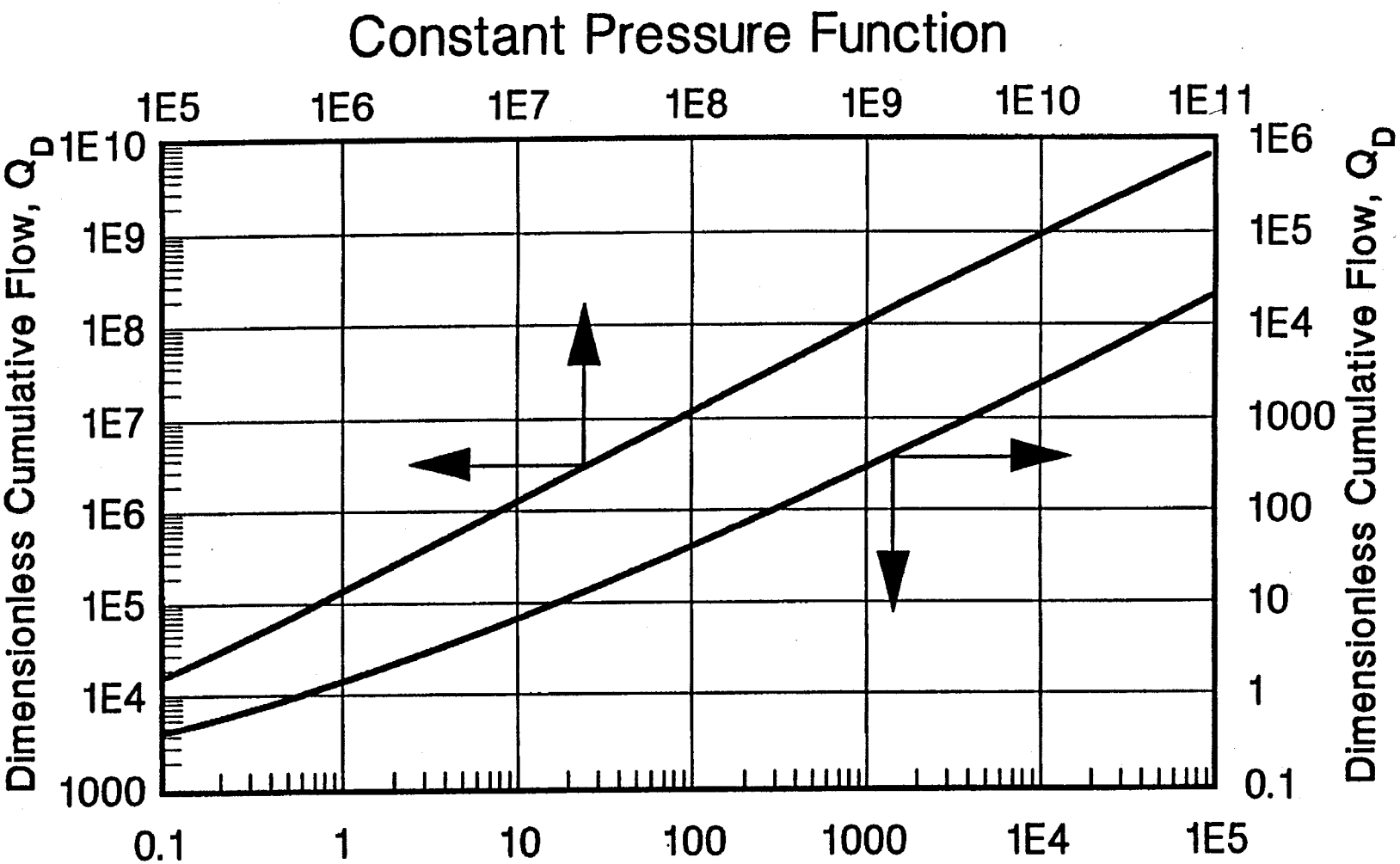
FIG. 11 is a graph illustrating the Hurst-van Everdingen Constant Pressure $Q_D$ function for infinite acting radial flow.

The cumulative volume of water injected during the test can be estimated by the constant-terminal-pressure solution of the radial diffusivity equation. FIG. 11 was produced from this solution and indicates a solution for an infinite acting reservoir in terms of $t_d$ and $Q_{DW}$ where:

$$t_D=\frac{0.0002637kt}{\phi u c_t r_w^2}$$

and $$Q_{Dw}=\frac{Q_w}{1.12\phi h c_t r_w^2\Delta P}$$

Even though the Tank Test is not a constant pressure injection, the constant pressure solution should be adequate for test design since the change in pressure head of the tank should be relatively small compared to the pressure differential driving the injection. The cumulative injection volume is estimated by calculating the dimensionless time from the above $t_D$ equation and then determining $Q_D$ from FIG. 11 and using the following equation:

$$Q_w=1.12Q_D\phi h c_t r_w^2\Delta P$$

To account for different skin factors, the apparent wellbore radius can be used instead of the actual wellbore radius by:

$$r_{wa}=r_w e^{-s}$$

Once the injection volume is estimated, a tank size can be selected. Tank size is not critical but should be small enough that the water level changes significantly during the test so that an accurate injection rate can be determined. Too small of a tank should also be avoided because this will require frequent refilling which may be inconvenient and may introduce additional errors.

If the reservoir is not 100% water saturated, it may still be possible to perform a successful Tank Test by injecting enough water to create a water saturated zone around the well and then analyzing the early time falloff response while the pressure transient is still within the water bank. The following material balance equation may be used to estimate the distance to the edge of the water bank.

$$r_{wb}=\sqrt{\frac{5.615Q_w B_w}{\pi h\phi\Delta S_w}}$$

The test should be designed so that wellbore storage effects have dissipated by the time that the radius of investigation has exceeded the radius of the water bank $r_{wb}$. In most cases this will require a very long injection duration (to make $r_{wb}$ relatively large) and downhole shut-in to minimize the time for wellbore storage effects to end.

EXAMPLE 1

The following example illustrates how a pre-frac Tank Test for a water saturated coal seam can be designed. Design Parameters: Coal Thickness=6 ft. Water Viscosity=0.90 cp Porosity=1.5% Compressibility=4.0 $\times10^{-4}$ psi Wellbore Radius=0.328 ft. Expected Permeability=4 md Depth to Coal Seam=1000 ft. Equilibrium Water Level=180 ft. below top of casing Assumed Skin Factor=−1 Water Density=62.4 lb/ft$^3$ Tubing Diameter=1.049 in.

Wellbore Storage Effects

Calculate the end of wellbore storage in the worst case (2 md). Cross sectional area of the tubing:

$$A=\frac{1}{4}\pi\left(\frac{1.049}{12}\right)^2=0.006\ \text{ft}^2$$

Wellbore storage coefficient for changing fluid level was calculated according to:

$$C=\frac{(144)(0.006)}{(5.615)(62.4)}=0.0025\ \text{bbl/psi}$$

Estimate the end of wellbore storage by:

$$t_{wbs}=\frac{(170{,}000)(0.0025)e^{(0.14)(-1)}}{(6)(4)/0.9}=17\ \text{hrs}$$

Use test duration at least four times longer than $t_{wbs}$. Inject for 72 hours and fall off for 72 hours. Calculate the radius of investigation from:

$$r_i=0.029\sqrt{\frac{(4)(72)}{(4.0\times10^{-4})(0.015)(0.90)}}=212\ \text{ft}$$

The radius of investigation is probably adequate, but if desired, could be increased by increasing test duration. The injection volume is:

$$r_{wa}=0.328e^1=0.8916\ \text{ft}$$

$$t_D=\frac{(0.0002637)(4)(72)}{(0.015)(0.90)(4\times10^{-4})\,(0.8916)^2}=17{,}700$$

From FIG. 11, $Q_D$=3800.

$$\Delta P=\frac{(180\ \text{ft})(62.4\ \text{lb/ft}^3)}{(144\ \text{in}^2/\text{ft}^2)}=78\ \text{psi}$$

$$Q_w=(1.12)(3800)(0.015)(6)(4.0\times10^{-4})(0.8916)^2(78)Q_w=9.5\ \text{bbl}$$

In summary, the design example specifies use of 1.049 inch inside diameter tubing, inject for days and falloff for 3 days. Tank size should have a capacity of approximately 10 barrels.

The Tank Test provides high quality data at low cost when testing under-pressured reservoirs. The procedure has been successfully performed as pre-and post-frac tests. By eliminating surface pumping equipment and the associated manpower, and by using ground water monitoring gauges in place of oil field gauges, the Tank Test can be performed at much lower cost than an injection/falloff test which requires pumps. Due to the low cost, Tank Test can be performed for a longer duration. This provides a greater radius of investigation and should result in a permeability more representative of the reservoir. An additional advantage of the Tank Test is that the injection rate is controlled by the formation properties and the amount of hydrostatic head. This means that an injection rate does not need to be chosen and the common problem of fracturing the coal during injection is virtually eliminated.

In summary, this disclosure illustrates an apparatus for performing injection tests on low-pressured reservoirs. The associated equipment is arranged by having a vessel or tank for containing a quantity of water where the water level creates a measuring line. Tubing inside a well is vertically stabilized within the wellbore by at least one packer. The tubing extends vertically above ground surface and often has an expansion chamber attached to the top of the tubing. A flow communication means for transporting the water from the tank to the tubing, typically consists of a pipe. Located in close proximity to the wellhead and connected to the pipe connecting the tank and tubing is a water shut-off valve. It is important that the water level in the tank is kept above the point where the water enters the tubing.

An indicator for determining the flow rate of the water into the tubing from the tank is connected to a recorder or a means for recording the flow rate data. This can be accomplished by a pressure gauge located in the tank or a flow meter measuring the water outflow of the tank. If a pressure gauge is used, calculation of water volumes is easier if a tank with a constant cross sectional area is used. A tank with a variable cross sectional area, such a typical frac tank can also be used. However, calculation of water volumes is more complicated. A second indicator is required for determining the pressure in the tubing.

When testing a formation that can communicate with other formations, a bridge plug is required just below the formation of interest to isolate that formation. When the formation of interest has low permeability, a narrow tubing is recommended to minimize wellbore storage.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claims, including the full range of equivalency to which each element is entitled.

I claim:

1. An apparatus for performing injection tests on low-pressured reservoirs, comprising:

a vessel for containing water;

a tubing having an upper end and a lower end, said upper end exposed to atmospheric pressure;

a wellbore having a wellbore interior, said tubing located within said wellbore interior, at least one packer positioned within said wellbore interior and vertically stabilizing said tubing, said upper end of said tubing extending vertically above a water level within said vessel;

flow delivery means for transporting said water from said vessel to said tubing, wherein said flow delivery means controlling a flow rate of said water;

first measurement means for measuring said flow rate of said water, said first measurement means communicating flow rate data of said flow rate to recording means for recording said flow rate data; and second measurement means for measuring tubing pressure within said tubing at a location below said water level and for communicating tubing pressure data to said recording means for recording said tubing pressure data.

2. An apparatus accordingto claim 1, wherein at least one of said first measurement means and said second measurement means comprise a gauge sensing a pressure of said water.

3. An apparatus according to claim 1, wherein said first measurement means comprise a flow meter positioned to accept said water from at least one of said vessel and said flow means.

4. An apparatus according to claim 1, further comprising a bridge plug located within said wellbore interior below said lower end of said tubing, said bridge plug sealably isolating said wellbore interior from another formation.

5. An apparatus according to claim 1, wherein said vessel has a constant cross-sectional area.

6. An apparatus according to claim 1, wherein said vessel has a variable cross-sectional area.

7. An apparatus according to claim 1, wherein said water level is above a connection between said tubing and said flow delivery means.

8. An apparatus according to claim 1, further comprising a production tube said tubing having a diameter smaller than said production tube and located inside said production tube.

9. An apparatus according to claim 1, further comprising shut-in equipment positioned downhole within said wellbore interior for sealably isolating said wellbore interior from another formation, said shut-in equipment being attached to said lower end of said tubing.

10. An apparatus according to claim 1, wherein said first measurement means comprise a first pressure gauge exposed to said water in said vessel and said second measurement means comprise a second pressure gauge exposed to said water in said tubing.

11. An apparatus according to claim 1, wherein a portion of said tubing near said upper end of said tubing has an expansion chamber for holding excess said water.

12. An apparatus according to claim 1, wherein said flow delivery means comprise a valve positioned within a pipe that is in communication with said vessel and said tubing.

13. An apparatus according to claim 12, wherein said valve is located in close proximity to said tubing.

14. An apparatus for performing injection tests on low-pressured reservoirs, comprising:

a vessel for containing water;

a first tubing having an upper end and a lower end;

a wellbore having a wellbore interior, said first tubing located within said wellbore interior, at least one packer positioned within said wellbore interior and vertically stabilizing said first tubing;

a second tubing having a diameter smaller than said first tubing, said second tubing inserted within said first tubing and secured with respect to said first tubing, said second tubing exposed to atmospheric pressure;

shut-in equipment positioned downhole within said wellbore interior for sealably isolating said wellbore interior from another formation, said shut-in equipment being attached to said lower end of said first tubing or said second tubing;

flow delivery means for transporting said water from said vessel to said tubing;

said flow delivery means controlling an amount of said water;

first measurement means for measuring a flow rate of said water;

said first measurement means communicating flow rate data to recording means for recording said flow rate data;

second measurement means for measuring a wellbore interior pressure within said wellbore interior at a location below a water level within said vessel and for communicating wellbore interior pressure data to said recording means for recording said wellbore interior pressure data; wherein said first measurement means comprise a first pressure gauge exposed to said water inside said vessel and said second measurement means comprise a second pressure gauge exposed to said water inside said wellbore interior.

15. An apparatus according to claim 14, wherein at least one of said first measurement means and said second measurement means comprise a gauge sensing a pressure of said water.

16. An apparatus according to claim 14, wherein said first measurement means comprise a flow meter in communication with said water from said vessel.

* * * * *

UNITED STATES PATENT AND TRADEMARK OFFICE

CERTIFICATE OF CORRECTION

PATENT NO. : 5,621,170

DATED : April 15, 1997

INVENTOR(S) : Jerrald L. Saulsberry

It is certified that error appears in the above—identified patent and that said Letters Patent is hereby corrected as shown below:

Column 10, line 46, delete "controlling" and in its place insert --controls--.

Column 10, line 57, delete "accordingto" and in its place insert --according to--.

Signed and Sealed this

Nineteenth Day of August, 1997

Bruce Lehman

*Attest:*

BRUCE LEHMAN

*Attesting Officer*

*Commissioner of Patents and Trademarks*